US007921527B2

(12) United States Patent
Moy

(10) Patent No.: US 7,921,527 B2
(45) Date of Patent: Apr. 12, 2011

(54) TOWEL CLIP

(76) Inventor: Carey Moy, San Antonio, TX (US)

( * ) Notice: Subject to any disclaimer, the term of this patent is extended or adjusted under 35 U.S.C. 154(b) by 0 days.

(21) Appl. No.: 12/421,119

(22) Filed: Apr. 9, 2009

(65) Prior Publication Data

US 2010/0088863 A1 Apr. 15, 2010

(51) Int. Cl.
*B42F 1/00* (2006.01)
*B42F 1/10* (2006.01)

(52) U.S. Cl. ..... 24/462; 24/545; 24/910; D8/395

(58) Field of Classification Search ..... 24/545, 24/570, 564, 556, 561, 566, DIG. 22, DIG. 28, 24/DIG. 29, 462, 312, 326, 910, 487, 67.3, 24/67.9, DIG. 8, DIG. 9, 460, 3.12
See application file for complete search history.

(56) References Cited

U.S. PATENT DOCUMENTS

| | | | | |
|---|---|---|---|---|
| 2,470,811 A | | 5/1949 | Engleman | |
| 3,086,264 A | * | 4/1963 | Tindall | 24/30.5 R |
| 3,978,555 A | * | 9/1976 | Weisenthal | 24/543 |
| D298,711 S | | 11/1988 | Lowance | |
| 5,692,806 A | * | 12/1997 | Jones | 297/483 |
| D453,294 S | | 2/2002 | Bitzer | |
| 6,405,415 B1 | | 6/2002 | Meeks | |
| 6,457,218 B1 | | 10/2002 | Lawrence | |
| 6,547,218 B2 | | 4/2003 | Landy | |
| 2003/0056344 A1 | | 3/2003 | Brogdon, III | |
| 2003/0101551 A1 | | 6/2003 | Levesque | |
| 2005/0066488 A1 | | 3/2005 | Brogdon | |

FOREIGN PATENT DOCUMENTS

GB 2362918 A 12/2001

* cited by examiner

*Primary Examiner* — Robert J Sandy
(74) *Attorney, Agent, or Firm* — Jackson Walker, LLP

(57) ABSTRACT

A towel clip for securing a towel around the waist of a user, the towel clip typically including a body. The body has a longitudinal axis, and an inner and outer surface. The body has a first leg and a second leg and a bridge section. The bridge section is typically semicircular and the first leg and second extend outward therefrom. An embodiment of Applicant's towel clip includes a convex upper rail located on the inner surface of the first leg and a pair of convex lower rails spaced apart on the lower legs and extending upward from the inner surface of the lower leg. The bridge section is resilient and the legs will spread apart to exert pressure on a folded towel to secure the same.

4 Claims, 4 Drawing Sheets

TOWEL CLIP

This application claims priority from and the benefit of U.S. Design Patent Application Ser. No. 29/312,268, filed Oct. 10, 2008, entitled "Towel Clip."

FIELD OF THE INVENTION

The subject invention relates to towels. More particularly, the subject invention relates to a device for releasably securing a beach or bath towel around a person's body.

BACKGROUND OF THE INVENTION

It is well known that one may secure a towel about their body by wrapping the towel around the body and folding the edges or the top corner of the outer layer behind one or more of the wrapped inner layers. However, once secured about the body, the towel may loosen up, especially with movement of the body. That is to say, the tucked or folded sections of the towel may loosen causing the towel to slide or fall to the ground. This problem is aggravated with heavy towels, some towels being 30-36 inches wide by 60-70 inches long, with a weight of typically over 1 pound.

Therefore, there is a need for an easy-to-use device that will securely and releasably maintain the towel folded around the body. The invention set forth herein is directed to providing a convenient, secure towel.

SUMMARY OF THE INVENTION

A device for securing a towel around a waist, the device comprising a body having a longitudinal axis and having an inner and an outer surface, the body further comprising a first leg, a second leg, and a bridge section connecting the first leg and the second leg. A convex upper rail extends from the inner surface of the first leg toward the second leg, generally along a longitudinal axis thereof. At least two convex lower rails, extend from the inner surface, spaced apart laterally from the longitudinal axis of the lower leg.

DETAILED DESCRIPTION OF THE PREFERRED EMBODIMENTS

Figure 1:
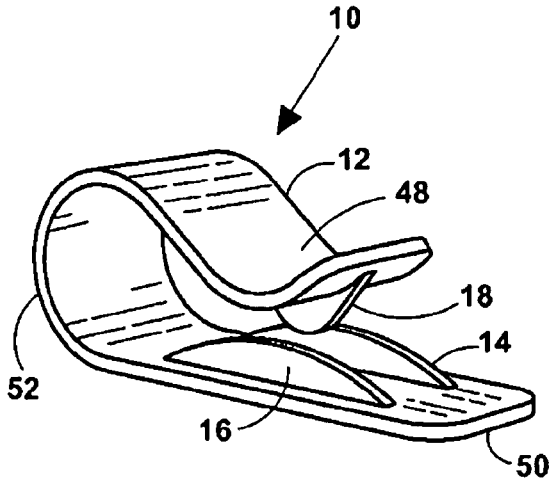
FIG. 1 is a perspective view of Applicant's novel towel clip.

FIGS. 1-12 illustrate various views of Applicant's novel towel clip 10. Towel clip 10 is seen to be an integral structure comprising a body 12, to which is attached, or otherwise engaged a pair (typically) of spaced apart, upstanding lower rails 14 and 16, and typically, a single, upstanding upper rail 18. Lower rail 16 is seen to have an outer side wall 20 and an inner side wall 22. Lower rail 14 is seen to have inner side wall 24 and outer side wall 26. Lower rail 16 has a top wall 28, and lower rail 14 has a top wall 30. Upper rail 18 is seen to have a first side wall 32 and an opposed second side wall 34, as well as a top wall 36.

Figure 12:
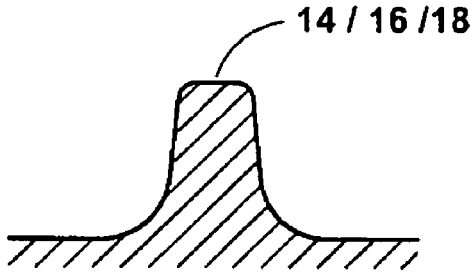
FIG. 12 is an alternate preferred embodiment of the rails showing that they may include curved side walls that curve as they come off the body and curve as they blend into the top wall of the rail.

Lower rail 16 has a leading edge 37 and a trailing edge 38, these edges being where the rail meets body inner surface 56. Lower rail 14 is seen to have a leading edge 44 and a trailing edge 46. Upper rail 18 has a leading edge 40 and a trailing edge 42 where the upper rail meets body inner surface 56. The rails may be rectangular in cross section or rounded as seen in FIG. 12.

Figure 5:
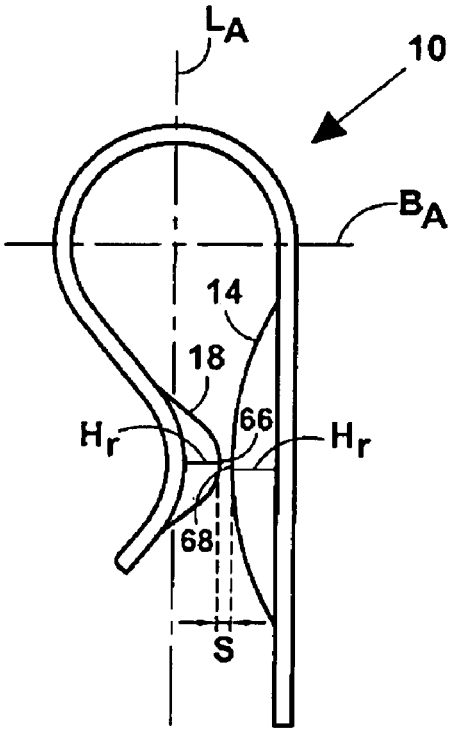
Figure 6:
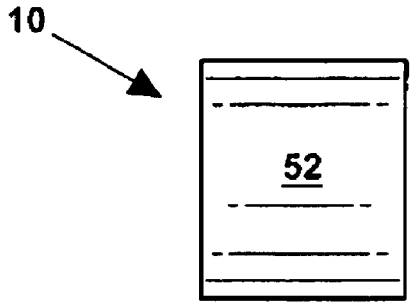
FIG. 6 is a rear elevational view of Applicant's novel towel clip.
Figure 11:
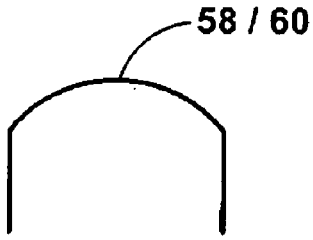
FIG. 11 is a view similar to FIG. 3 that illustrates that the ends of the leg of the clip may be curved.

Turning now to body 12, body 12 is seen to comprise an outer leg 48 and an inner leg 50. Legs 48 and 50 extend from a bridge portion 52, which is typically semicircular in profile as seen in FIG. 5. The bridge portion both positions the legs in spaced apart relation and provides at least some of the resiliency to the legs. The bridge portion may be slightly thicker than the legs, as seen in FIG. 1D. Moreover, inner leg 50 is seen to extend straight or planar from the end of bridge 52 whereas, in profile, outer leg 48 is seen to extend from the end of the bridge, but to have a curvilinear, typically concave, section, terminating short typically, of the termination of inner leg 50. In an alternate embodiment, both legs may be the same length. Body 12 includes a body inner surface 56 and a body outer surface 54. The inner leg 50 terminates at inner leg front edge 58 and the outer leg 48 terminates at outer leg front edge 60 The front edges may be straight, as in FIG. 3, or rounded as seen in FIG. 11.

Figure 3:
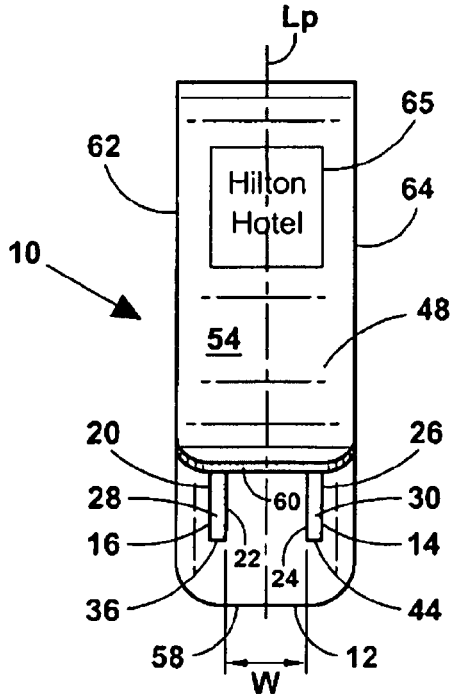
FIG. 3 is a top elevational view of Applicant's novel towel clip.

FIGS. 3 and 5 help illustrate some of the dimensions, spacing, and other features of Applicant's novel towel clip 10. FIG. 5 is seen to illustrate a longitudinal axis LA, which is perpendicular to the bridge axis BA. Bridge axis BA is seen to define a generally semicircular bridge 52 as seen in FIG. 5. A longitudinal axis LA is perpendicular to a bridge axis BA. The longitudinal plane Lp is seen in FIG. 3.

Figure 2:
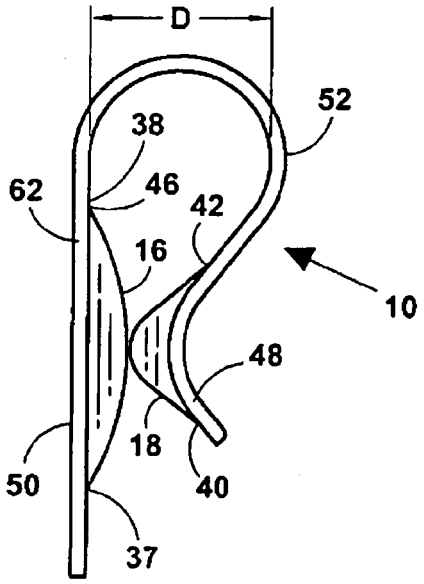
FIGS. 2 and 5 illustrate a side elevational view of Applicant's novel towel clip.
Figure 4:
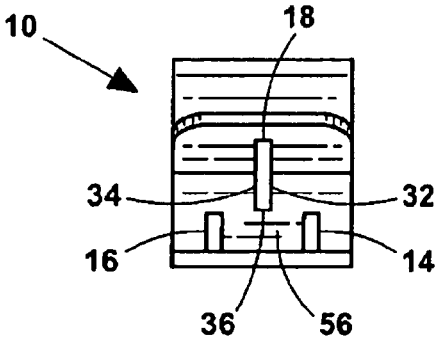
FIG. 4 is a front elevational view of Applicant's novel towel clip.

Upper rail 18 is seen to be generally convex and having apex 66, which is spaced apart from body inner surface 56 by a height Hr. Likewise, both lower rails 14/16 are seen to be dimensioned substantially identical to one another having apex 68 (same numeral for each) and having a height above body inner surface 56 of Hr and both similarly dimensioned lower rails are convex. Lower rails spaced apart width W (see FIG. 3) and the distance vertically as seen in profile between apex 66 and apexes 68 is typically given by spacing dimensioned S, which spacing may be in the range of ⅛ inch positive, 0 or ⅛ inch negative (preferred about 0). Herein a negative spacing means that the apexes overlap as seen in profile (see FIG. 2) with apex 66 being closer to inner leg 50 than height Hr of the lower rails. FIG. 2 shows a spacing S of about "0".

In a preferred embodiment, the legs, bridge, and rails are integral and are typically molded from a hard plastic or other suitable resilient material, such as a polycarbonate or a polycarbonate glass mixture. This material may be scented. The outer side walls of either the upper or lower rails or any other location on the clip may contain indicia 67/67, such as promotional logos, phrases, trademarks, images, pictures, the trademark of the product or other information, thereupon (see FIGS. 3 and 7).

Aspect ratio is the ratio of the straight line distance between the trailing edge and the leading edge of a rail and the distance to the highest point on the rail that is perpendicular to the straight line distance between the leading and trailing edges. A long, flat rail that is not very high would have a high aspect ratio. For example, if the distance between the leading and trailing edge was 1.5 inches and the height or perpendicular distance were 1/10 inch, the aspect ratio would be 15. Here, in a preferred embodiment, the aspect ratios are typically in the range of about 4 to 10 for the lower rails (preferred about 7) and 1 to 5 for the upper rail (preferred about 3).

The width, that is the distance between the inner walls of the two lower rails (or the two outermost rails if there are more than two), is typically in the range of 0.25 to 0.75 inches (preferred about ½ inch), especially when a single up rail is utilized, which is centrally located between the two lower rails. The distance D is the inside measurement across the bridge in the range of ½ inch to 1¼ inch (preferred about 1.0 inch).

The top and bottom views illustrate that the legs are substantially rectangular and that one leg typically includes a section that in profile is curved and, in a preferred embodiment, the curved leg (again in profile) is usually the leg that has the single rail juxtaposed between the two lower rails.

Some alternate preferred embodiments have been disclosed above. Other alternate preferred embodiments include the following: both legs may extend straight from the bridge or both legs may extend curved (in profile); the spaced apart pair of rails may be on either leg; the bridge may have a constant radius of curvature or the curvature may vary; the curvature defining the rails may vary from that illustrated, which radius of curvature may be constant or vary; and the number of rails on the legs may vary 2/1 3/2, 2/2, etc. In a preferred embodiment, there is an odd number of rails on one leg and an even number on the other with the larger number of rails having a larger "W". The rails in a preferred embodiment are convex, but may be rectangular or other suitable shape.

Figure 7:
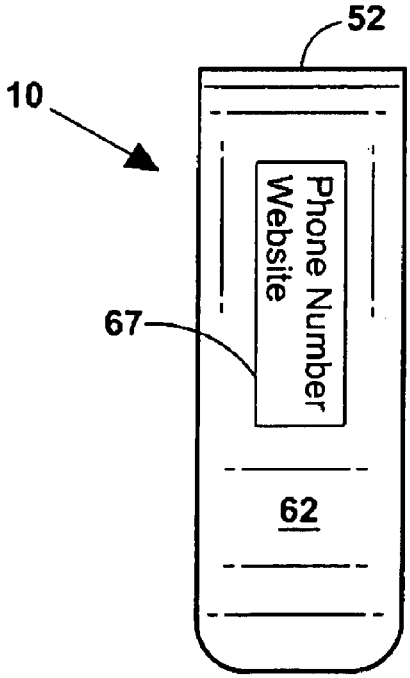
FIG. 7 is a bottom elevational view of Applicant's novel towel clip.
Figure 8:
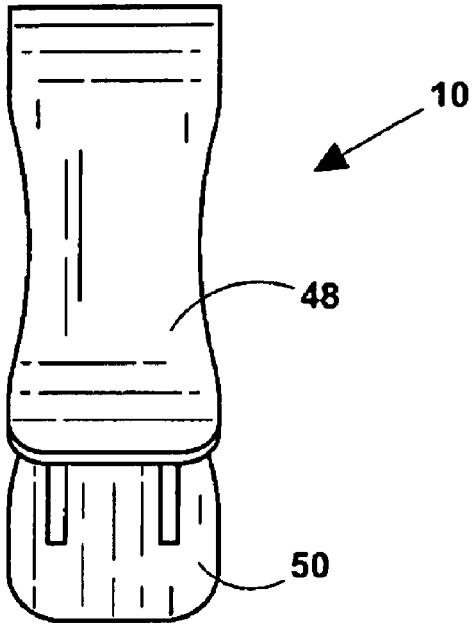
FIGS. 8 and 9 illustrate a preferred alternate embodiment in which the legs, in top and bottom views, appear curved.
Figure 9:
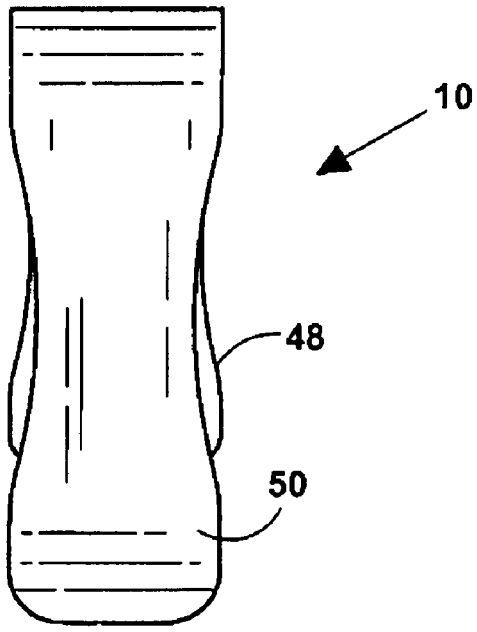
Figure 10:
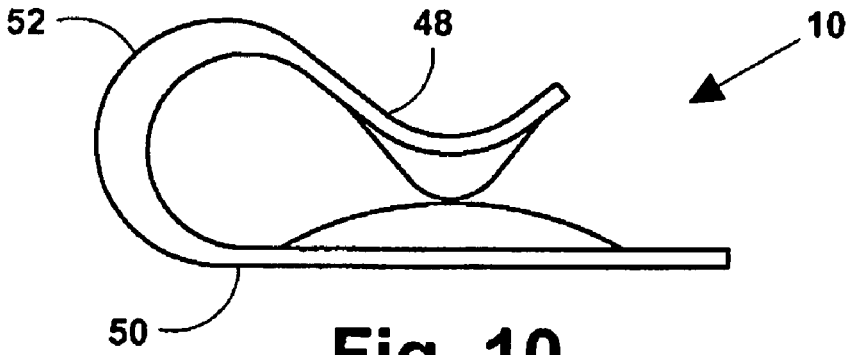
FIG. 10, a view similar to FIG. 2, illustrates an alternate preferred embodiment in which the bridge section thickens as compared to the legs.

Set forth above is an embodiment in which indicia may be located on the outer side walls or any side walls of the rails. As seen in FIG. 3, indicia 65 may be located on the outer surface of an upper leg or, as illustrated in FIG. 7, may be located on the outer surface of the lower leg. In one embodiment, indicia includes the trademark name and/or logo of a hotel, motel or resort along with the telephone number, address, and website information regarding the same.

FIGS. 8-12 illustrate features of Applicant's alternate preferred embodiments, which may be used alone or in combination with the various features of the preferred embodiment as illustrated above.

Although the invention has been described in connection with the preferred embodiment, it is not intended to limit the invention's particular form set forth, but on the contrary, it is intended to cover such alterations, modifications, and equivalences that may be included in the spirit and scope of the invention as defined by the appended claims.

The invention claimed is:

1. A device for securing a towel to a person's body, the device comprising:

a body having a longitudinal axis and having an inner and an outer surface, the body further comprising a first leg, and a second leg, and a bridge section connecting the first leg and the second leg;

at least one convex upper rail extending from the inner surface of the first leg toward the second leg, generally along a longitudinal axis thereof;

at least two convex lower rails, extending from the inner surface, spaced apart laterally from the longitudinal axis of the lower leg; and wherein the each of the rails has an aspect ratio; and wherein the aspect ratio of the lower rails is between about 4 and about 10 and wherein the aspect ratio of the upper rails is between about 1 and about 5.

2. The device of claim 1, further including indicia thereon.

3. A device for securing a towel around a waist, the device comprising:

a body having a longitudinal axis and having an inner and an outer surface, the body further comprising a first leg, and a second leg, and a bridge section connecting the first leg and the second leg;

at least one convex upper rail extending from the inner surface of the first leg toward the second leg, generally along a longitudinal axis thereof;

at least two convex lower rails, extending from the inner surface, spaced apart laterally from the longitudinal axis of the lower leg;

wherein the each of the rails has an aspect ratio; and wherein the width between the two lower rails is in the range of about 0.25 to about 0.75 inches; wherein the aspect ratio of the lower rails is between about 4 and about 10 and wherein the aspect ratio of the upper rails is between about 1 and about 5; wherein the spacing between the upper rail and the at least two lower rails defines a gap and wherein the gap is in the range of about −⅛ inch to +⅛ inch; and wherein an inner diameter of the bridge section is in the range of about 1 ½ inch to about 1 ¼ inch.

4. The device of claim 3, further including indicia thereon.

* * * * *